US005118406A

United States Patent [19]

Kokayeff et al.

[11] Patent Number: 5,118,406

[45] Date of Patent: Jun. 2, 1992

[54] HYDROTREATING WITH SILICON REMOVAL

[75] Inventors: Peter Kokayeff, Fullerton; Danford E. Clark, Fountain Valley; Howard D. Simpson, Irvine, all of Calif.

[73] Assignee: Union Oil Company of California, Los Angeles, Calif.

[21] Appl. No.: 693,369

[22] Filed: Apr. 30, 1991

[51] Int. Cl.[5] ..... C10G 45/00

[52] U.S. Cl. ..... 208/88; 208/210; 208/212; 208/254 R; 208/254 H; 208/251 R

[58] Field of Search ..... 208/210, 212, 254 R, 208/254 H, 251 R, 88

[56] References Cited

U.S. PATENT DOCUMENTS 4,176,047 11/1979 Orrell et al. ..... 208/51
4,645,587 2/1987 Kokayeff ..... 208/91
4,686,030 8/1987 Ward ..... 208/216 PP
4,729,826 3/1988 Lindsay et al. ..... 208/211
4,776,945 10/1988 Washecheek et al. ..... 208/210
4,789,462 12/1988 Byrne et al. ..... 208/210
4,846,961 7/1989 Robinson et al. ..... 208/216 PD

*Primary Examiner*—Theodore Morris
*Assistant Examiner*—P. L. Hailey

[57] ABSTRACT

A catalytic hydrotreating process wherein silicon-containing contaminants contained in a hydrocarbon feedstream are deposited onto a hydrotreating catalyst bed during hydrotreating in a manner providing improved catalyst stability. Hydrotreating catalysts having relatively high activities and low surface areas are located downstream of upstream hydrotreating catalysts having relatively low activities and high surface areas.

31 Claims, No Drawings

HYDROTREATING WITH SILICON REMOVAL

BACKGROUND OF THE INVENTION

This invention relates to hydrocarbon conversion catalysts, and particularly to those utilized to catalyze the reaction of hydrogen with organic compounds containing nitrogen and/or sulfur so as to yield a denitrogenated and/or desulfurized product. More particularly, the invention relates to a process for removing compounds containing silicon from hydrocarbon streams and is particularly concerned with a process for removing organosilicon compounds from reformer feedstocks to prevent silicon poisoning of the reformer catalyst.

In the refining of liquid hydrocarbons derived from mineral oilos and other sources, ti is often desirable to subject the liquid hydrocarbon or fraction thereof to hydrotreating. Hydrotreating is a refining process wherein liquid hydrocabons are reacted with hydrogen. Hydrotreating is often employed to reduce the concentration of olefins and oxygen in hydrocarbons. Hydrotreating is most commonly employed, however, to reduce the concentration of nitrogen and/or sulfur in hydrocarbon-containing feedstocks. Reducing the concentration of nitrogen and sulfur produces a product hydrocarbon which, when eventually combusted, results in reduced air pollutants of the forms $NO_x$ and $SO_x$. Reducing the concentration of nitrogen is also desirable to protect other refining processes, such as hydrocracking, which employ catalysts which deactivate in the presence of nitrogen.

In general, the hydrotreating of a nitrogen and/or sulfur-containing feedstocks is carried out by contacting the feedstock with hydrogen at elevated temperatures and pressures and in the presence of a suitable catalyst so as to convert the nitrogen to ammonia and the sulfur to hydrogen sulfide.

A typical hydrotreating catalyst comprises particles containing a Group VIII active metal component and a Group VIB active metal component supported on a refractory oxide such as alumina. Phosphorus components are commonly incorporated into the catalyst to improve its activity by increasing its acidity. One catalyst which has been successfully employed on a commercial basis consists essentially of molybdenum, nickel, and phosphorus components supported on gamma alumina. Improved activities and stabilities of such catalysts are continuously being sought. The higher the activity of the catalyst, the lower the reactor temperature required to obtain a product of given contaminant (sulfur, nitrogen, etc.) content from the feedstock. The lower the reaction temperature, the lower the expense of hydrotreating a given unit of feedstock due to savings in process heat requirement. Furthermore, hydrotreating at a lower reaction temperature usually extends the life of the catalyst, i.e., increases catalyst stability, assuming, of course, that all other process parameters are held constant.

Catalytic reforming is a conventional refining process which is utilized for such purposes as dehydrogenation, hydrogenation, cyclization, dehydrocyclization, isomerization and dehydroisomerization of selected hydrocarbons. Catalytic reforming is normally utilized to upgrade straight run or cracked naphtha feedstocks by increasing the octane number of the feedstock's gasoline fraction. In a typical reforming process in which a straight run or cracked naphtha is upgraded, the feedstock is contacted with a catalyst comprising a noble metal on alumina. The conditions utilized in the reforming process will vary depending upon such factors as the type of feed being processed and the desired increase in octane level.

Reforming catalysts, particularly those containing platinum, and most particularly those comprising platinum, rhenium and chlorine, are poisoned or deactivated rapidly in the presence of sulfur components. Thus, to achieve maximum run lengths and increase process efficiency, it is necessary to reduce the sulfur content of reformer feedstocks as low as possible.

In addition to being highly sensitive to sulfur components, reforming catalysts are also poisoned by compounds containing silicon. One common source of hydrocarbon streams containing silicon compounds is the delayed coking unit utilized in many petroleum refineries. Such a unit is used to convert residual oils into more valuable products. The overhead vapors from the coking drum, which is part of the delayed coking unit, are normally fractionated into various cuts including a gasoline boiling range stream commonly referred to as coker gasoline or coker naphtha. This stream generally possesses a low octane number and is therefore unsuitable for use as automotive fuel without upgrading. Thus, it has become common practice to increase the octane number of coker gasoline by subjecting it to catalytic reforming. The coker gasoline will not only contain sulfur (and nitrogen) compounds but, quite frequently, will contain organosilicon components derived from silicon defoamers, such as polydimethyl siloxanes, added in the delayed coking process to prevent foaming.

It is desirable to remove both sulfur compounds and silicon compounds from coker gasoline and other hydrocarbon streams that are to be processed in catalytic reformers. If a stream containing both sulfur and silicon compounds is subjected to catalytic hydrodesulfurization or hydrotreating, the sulfur will not only be removed by conversion to hydrogen sulfide (and the nitrogen to ammonia) but the silicon compounds will deposit on the catalyst. The deposited organosilicon components will have a deleterious effect on the hydrotreating catalyst, tending to deactivate it and decrease its stability.

Accordingly, the present invention provides a process for removing silicon components from hydrocarbon feedstreams during catalytic hydrodesulfurization or hydrotreating. The invention further provides a process for removing silicon components from feedstreams which have previously been subjected to delayed coking. Alternatively, the invention provides a process which can be used to simultaneously remove sulfur (and/or nitrogen) and silicon components from hydrocarbon-containing feedstreams such as reformer feeds.

SUMMARY OF THE INVENTION

Briefly, the invention relates to a catalytic hydrotreating process wherein silicon-containing contaminants in a hydrocarbon-containing feedstock are deposited onto a catalyst bed containing at least two different hydrotreating catalysts. The catalyst bed contains an upstream portion of hydrotreating catalyst having a relatively high surface area and low hydrotreating activity, and further contains a downstream portion of a second hydrotreating catalyst having a relatively high hydrotreating activity. Compared to the downstream catalyst, the upstream catalyst has greater silicon deposition capacity. Compared to a hydrotreating process employing a catalyst bed of a single hydrotreating catalyst, the multiple catalyst bed system of the present invention provides greater overall catalyst stability without sacrificing catalyst activity.

DETAILED DESCRIPTION OF THE INVENTION

In the process of the present invention silicon, sulfur and/or nitrogen contaminants are concurrently removed from a hydrocarbon-containing feedstock. A multi catalyst fixed bed is employed in the hydrotreating process of the invention wherein the feedstock contacts the multi-catalyst bed under hydrotreating conditions to produce a hydrocarbon-containing product of reduced concentration of (1) silicon and (2) either sulfur or nitrogen compared to the feedstock. At least two, and preferably at least three different hydrotreating catalysts are employed in the multi-catalyst bed in the process of the invention.

The multi-catalyst bed is a graded bed of particulate catalyst in a single hydrotreating reactor vessel or a series of reactor vessels wherein a catalyst first contacted by the feedstock (in the most upstream portion of the catalyst reaction zone) has a greater surface area than the surface area of a different catalyst subsequently contacted in a downstream reaction zone. In other words, the upstream and downstream catalyst reaction zones may be located in the same or separate reactor vessels with the feedstock serially contacting first an upstream catalyst and then a downstream catalyst or catalysts. In a preferred embodiment wherein the graded bed contains at least three different catalysts, the catalyst in the most downstream location of the bed typically has the smallest surface area and/or the highest hydrotreating activity relative to the other catalysts while the catalyst in the most upstream position is opposite, i.e., having the least hydrotreating activity and the highest surface area.

With respect to silicon removal from a feedstock, the catalyst located in the most upstream portion of the bed has the least hydrotreating activity and the greatest capacity for accumulating silicon (via deposition) compared to capacities of downstream portions of a different catalyst or catalysts. In the preferred embodiment wherein at least three different catalysts are employed, the catalyst located in the most downstream portion of the bed has the smallest capacity for accumulating silicon while catalysts located intermediate from the upstream toward downstream catalysts have diminishing intermediate capacities and increasing hydrotreating activities.

In contrast to either utilizing a bed containing a single hydrotreating catalyst or utilizing a bed containing a more active catalyst in the most upstream location of the catalyst bed, the process of the invention utilizes an upstream hydrotreating catalyst having greater surface area, better capacity for accumulating silicon and lesser activity and thus provides unexpectedly better overall stability for removing silicon, nitrogen, and sulfur from the feedstock.

Catalysts employed in the present invention typically contain at least one hydrogenation metal component on a porous refractory oxide support and/or have at least some activity for hydrotreating hydrocarbon-containing feedstocks to convert sulfur and/or nitrogen components of the feedstock to hydrogen sulfide and/or ammonia, respectively. A preferred catalyst contains at least one Group VIB metal hydrogenation component and/or at least one Group VIII metal hydrogenation, and optionally and preferably, at least one phosphorus component on the porous refractory support. In a highly preferred embodiment, the catalyst contains at least one cobalt or nickel hydrogenation component, at least one molybdenum hydrogenation component, and at least one phosphorus component supported on an amorphous, porous refractory oxide containing alumina, preferably gamma alumina.

Porous refractory oxide support material of the catalysts employed herein typically contains amorphous inorganic refractory oxides such as silica, magnesia, silica-magnesia, zirconia, silica-zirconia, titania, alumina, silica-alumina, etc., with supports containing gamma, theta, delta and/or eta alumina being highly preferred. Such support material is utilized to prepare catalysts having physical characteristics including a total pore volume greater than about 0.2 cc/gram and a surface area greater than about 100 $m^2$/ gram Ordinarily the total pore volume of the catalyst is about 0.2 to about 0.7 cc/gram, and preferably about 0.25 to about 0.60 cc/gram, and the surface is in the range from about 150 to about 500 $m^2$/gram, and preferably about 175 to about 350 $m^2$/gram.

Furthermore, preferred catalysts have a relatively narrow pore size distribution wherein at least about 75 percent, preferably at least about 80 percent, and most preferably at least about 85 percent of the total pore volume is in pores of diameter from about 50 to about 110 angstroms. Another porosity feature of preferred catalysts employed herein is the narrow pore size distribution of pores of diameter slightly above or below the median pore diameter which typically lies in the range from about 65 to about 90 angstroms, preferably about 70 to about 85 angstroms. Ordinarily, at least about 50 percent of the total volume of the catalysts is contained in pores of diameter within 50 angstroms of the median pore diameter.

Examples of hydrogenation metals loadings and physical characteristics of preferred catalysts for use herein are disclosed in U.S. Pat. No. 4,846,961 issued to Robinson et. al. and U.S. Pat. No. 4,686,030 issued to Ward, the disclosures of which are incorporated by reference herein in their entireties. Catalysts exhibiting incremental increases in molybdenum content and corresponding increases in denitrogenation activity, such as those disclosed in the Robinson et al. patent, can readily be employed in suitable upstream and/or downstream locations In one embodiment of the catalyst bed of the invention, the total number of moles of hydrogenation metals (particularly molybdenum), calculated as the free metals, contained on the porous refractory oxide support of a downstream hydrotreating catalyst is greater than the total number of moles of hydrogenation metals contained on the same porous refractory oxide support of a second hydrotreating catalyst located upstream relative to the downstream catalyst. As shown hereinafter in the Example, when the catalyst bed comprising a single hydrotreating catalyst is contacted with a hydrocarbon-containing feedstock contaminated with sulfur and nitrogen components under hydrotreating conditions, the single hydrotreating catalyst system containing a single catalyst having a greater number of moles of hydrogenation metals on a given support exhibits greater hydrotreating activity than the systems containing single catalysts with fewer total moles of hydrogenation metal on the same support. In the invention, the typical downstream hydrotreating catalyst is more active than the upstream hydrotreating catalyst, contains more hydrogenation metals on a given support and consequently has a reduced surface area compared to the upstream catalyst. Although the different hydrotreating catalysts contained in the graded catalyst bed of the invention can contain from as low as 1 weight percent of hydrogenation metals on a support and can contain different supports with different surface areas, ordinarily at least one, and often all the hydrotreating catalysts in the bed, contain at least 10 weight percent of one or more hydrogenation metals and have a surface area greater than 100 $m^2$/gram. Furthermore, each different catalyst contained in the bed preferably comprises at least about 10 volume percent of the bed.

Typical hydrocarbon feedstocks suitable for treatment herein are light and heavy gas oils, cycle oils, naphthas, kerosene, turbine fuels, diesel fuels and syncrudes such as shale oils. Among the preferred feedstocks are gas oils, and in particular, gas oils or vacuum gas oils having at least 50 percent of the components thereof boiling at temperatures less than about 700° F., preferably less than about 650° F., and having an end point less than 1,000° F., preferably less than 850° F. Highly preferred feedstocks include reformer feeds and diesel fuels. A typical feedstock to be treated by contact with the catalyst described herein contains at least 2 ppmw of nitrogen components (calculated as nitrogen), usually between about 10 and about 5,000 ppmw of nitrogen components, and at least 0.02 weight percent of sulfur comgonents (calculated as sulfur), usually between about 0.02 and about 4.0 weight percent and often between about 1.0 and about 3.0 weight percent. The nitrogen components and the sulfur components are generally present in the feedstock essentially completely in the form of organonitrogen and organosulfur compounds, respectively.

Furthermore, the process of the invention is used to treat any of the above described vaporous or liquid hydrocarbon feedstocks that contain silicon compounds, normally organosilicon compounds. Examples of preferred hydrocarbon-containing feedstocks that may be treated in the process of the invention include coker naphtha, virgin naphtha, cracked naphtha, kerosene, diesel and other distillate fuels and gas oils. Although feedstocks employed in the present invention may contain organosilicon contaminants, typically the source of the silicon compounds will comprise antifoam agents used to prevent foaming in upstream processes, such as delayed coking processes. Examples of silicon compounds that can be removed in the process of the invention include polysiloxane antifoam agents, silanes, and silanols. In general, the feedstocks contain greater than about 0.005 ppmw of silicon, calculated as Si, and usually from about 0.01 to about 500 ppmw of silicon. Often, the hydrocarbon feedstock will be a catalytic reformer feedstream containing silicon in a concentration ranging between about 0.01 and about 25 ppmw, typically between about 5 ppmw and about 15 ppmw.

Catalysts are activated in accordance with methods suited to hydrotreat a hydrocarbon-containing feedstock. Most of the catalysts used in the hydrotreating process of the invention are more active, sometimes far more active, in a sulfided form than in an oxide form in which they are generally prepared. Accordingly, the catalysts used herein may be sulfided prior to use by any known method (in which case the procedure is termed "presulfiding"), for example, by passing a sulfiding agent over the catalyst bed of catalysts prepared in the oxide form. Temperatures between 300° F. and 700° F. and gaseous space velocities between about 140 and 500 v/v/hr are generally employed, and this treatment is usually continued for at least two hours. A mixture of hydrogen and one or more components selected from the group consisting of sulfur vapor and sulfur compounds e.g., lower molecular weight thiols, organic sulfides, and especially $H_2S$) is suitable for presulfiding. Generally speaking, the relative proportion of sulfiding compounds in the presulfiding mixture is not critical, with any proportion of sulfur ranging between 0.01 and 15 percent by volume, calculated as S, being adequate. Also, liquid sulfiding agents, such as dimethyl disulfide and the like, may be used for presulfiding.

If the catalyst is to be used in a sulfided form, it is preferred that a presulfiding procedure be employed. However, since hydrotreating can be employed to upgrade the described sulfur-containing hydrocarbons (i.e., hydrodesulfurization), one may, as an alternative, accomplish the sulfiding in situ with sulfur-containing hydrocarbon-containing feedstocks, particularly those containing about 1.0 weight percent or more of sulfur, under hydrotreating conditions.

Hydrotreating with the catalysts herein is accomplished under conditions known in the art for denitrogenating and/or desulfurizing hydrocarbon feedstocks in the presence of hydrogen. In the usual instance, the feedstock is passed at an elevated temperature and pressure through a catalytic reactor containing a stationary bed of catalysts. Hydrogen is also passed through the reactor with the feedstock, and the hydrogen which is not consumed in Converting the nitrogen components to ammonia and the sulfur components to hydrogen sulfide is separated from the denitrogenated and/or desulfurized product oil and recycled to the inlet of the reactor. In the broad sense, the feedstock is subjected to hydrotreating conditions including an elevated temperature, typically above about 450° F., and an elevated pressure, usually above 50 p.s.i.g., in the presence of molecular hydrogen. The conditions employed vary from feedstock to feedstock, but the range of conditions set forth in the following table will be those typically employed:

TABLE I

| Operating Conditions | Suitable | Preferred |
|---|---|---|
| Temperature, °F. | 400–1,000 | 500–850 |
| Pressure, p.s.i.g | 100–5,000 | 300–3,000 |
| Space Velocity, LHSV | 0.1–15 | 0.5–10 |
| Hydrogen Recycle Rate cf/bbl | 400–20,000 | 1,000–15,000 |

Although the conditions chosen for any given feedstock will depend in large measure upon the quality of the product desired and the concentrations of sulfur and nitrogen in the feedstock, conditions are usually selected to remove a substantial proportion of both nitrogen and sulfur components, usually at least 50 percent, preferably at least 90 percent, and most preferably at least 95 percent of each of the components. Most preferably, conditions are chosen to reduce the nitrogen compounds concentration to less than 10 ppmw (as nitrogen) and the sulfur compounds concentration to less than 200 ppmw (as sulfur).

As used herein, the capacity for accumulating silicon on a hydrotreating catalyst described herein is the amount of silicon compound deposited on the catalyst prior to "silicon breakthrough." Silicon breakthrough occurs in the process of the invention when the concentration of silicon components contained in the feedstock is substantially the same as the concentration of silicon components in the hydrocarbon-containing product, i.e., silicon components in the feedstock and product differ from each other by less than 5 percent, on a weight basis, calculated as Si.

The process of the invention may include either serial or simultaneous silicon removal, desulfurization and denitrogenation of a feedstock, with the simultaneous or concurrent removal of silicon, sulfur and nitrogen being preferred. Simultaneous desulfurization, denitrogenation and silicon deposition on the catalyst bed involves contacting a hydrocarbon oil feedstock with the particulate catalysts disclosed herein under conditions effecting a lower silicon, sulfur and nitrogen concentration in the effluent compared to such concentrations in the feedstock. Serial silicon removal, desulfurization and denitrogenation of a feedstock by contact with the catalysts described herein involves removing sulfur and nitrogen from the feedstock either prior to or after contact of the feedstock with a catalyst effective for removing a substantial proportion of silicon compounds from the feed.

A preferred embodiment utilizing the graded bed of at least three catalysts comprises a combined silicon deposition, hydrodesulfurization and hydrodenitrogenation reaction zone wherein a highly active hydrotreating catalyst is located in a downstream portion of a fixed bed relative to an upstream bed portion of a different hydrotreating catalyst having a greater surface area than that of the downstream catalyst, with a third hydrotreating catalyst, different from the other two, located intermediate to the upstream and downstream hydrotreating catalysts and having both intermediate hydrotreating activity and intermediate capacity for accumulating silicon compared to the other two hydrotreating catalysts. The content of silicon, sulfur and nitrogen of the feedstock contacting the fixed bed under simultaneous silicon, sulfur and nitrogen removal conditions is reduced to a concentration (i.e., less than about 1 ppmw of i sulfur, calculated as S, nitrogen, calculated as N, and silicon, calculated as Si) which allows the hydrocarbon-containing product to be passed to a downstream refining unit intolerant to such described contaminants, such as a reformer (containing contaminant-sensitive catalysts), or a diesel fuel (which is combusted to emit pollutants containing such contaminants).

The concentration of organo-contaminant compounds (i.e., organosulfur, organonitrogen, organosilicon, etc.) remaining in the hydrocarbon-containing product obtained from the process of the invention is normally less than 50, preferably less than 20, and most preferably less than 10 percent of the organo-contaminants contained in the feedstock. In a preferred embodiment, about 96 to 98 percent of the nitrogen content of a typical feedstock is converted to a product containing about 1-2 ppmw nitrogen, calculated as N, with the product sulfur content being less than about 100 ppmw, calculated as S, and the silicon concentration being less than 1 ppmw, calculated as Si. In a typical commercial hydrotreating process, the hydrocarbon-containing product contains less than 10 ppmw each of sulfur, nitrogen, and silicon, and often the silicon concentration is less than 0.5 ppmw.

The invention is further illustrated by the following examples which are illustrative of specific modes of practicing the invention and are not intended as limiting the scope of the invention defined by the appended claims.

EXAMPLE

Three (3) Ni-P-Mo-alumina hydrotreating catalysts, designated as Catalysts B, C, and D, are prepared by the impregnation of identical gamma alumina support particles with aqueous solutions containing different amounts of nickel, molybdenum and phosphorus components. The catalysts are prepared by the following method:

1. An impregnating solution (IS) is prepared by suspending 93 1 grams of ammonium heptamolybdate (AHM) into 100 ml of water and dissolving the AHM by the addition of 30.8 grams of 85% phosphoric acid ($H_3PO_4$) solution into the AHM suspension. Fifty-four (54.0) grams of nickel nitrate hexahydrate [$NI(NO_3)_2 \cdot 6H_2O$] are then dissolved in the solution, and water is added to adjust the impregnating solution volume to 188 ml.

2. An alumina support is oven dried and calcined at 1200° F. for one hour in flowing air. The calcined support particles contain gamma alumina, have a total pore volume of 0.70 cc/gm (Hg intrusion), a median pore diameter of approximately 75 angstroms and a surface area of approximately 330 $m^2/gm$ (BET).

3. Three portions of the calcined support particles (209 grams in each portion) are pore saturated with 188 ml of diluted portions of the impregnating solution (IS).

In the preparation of Catalyst B, 151 ml of the impregnating solution (IS) is diluted with water to 188 ml and then contacted with the support particles. The impregnated support particles are aged for two (2) hours and then oven dried overnight at 110 C. The dried material is then calcined at 900° F. in flowing air.

Catalysts C and D are prepared in a similar manner to that of Catalyst B, except 113 ml and 75 ml portions, respectively, of the impregnating solution (IS) are diluted with water to produce 188 ml impregnating solutions.

The nominal compositions of the catalysts and their respective surface areas (B.E.T.) are summarized in the following Table II.

TABLE II

| Cat | $MoO_3$, wt % | N:O, wt % | $P_2O_5$, wt % | S.A., $m^2/g$ |
|---|---|---|---|---|
| B | 20.7 | 3.8 | 5.1 | 225 |
| C | 16.7 | 3.1 | 4.1 | 250 |
| D | 12.1 | 2.2 | 3.0 | 273 |

Four (4) separate experimental runs are conducted employing 15 ml portions of previously sulfided catalysts B alone (Run No. 1), C alone (Run No. 2), D alone (Run No. 3) and a combination of 33.3 volume percent of B, 33.3 volume percent of C and 33.3 volume percent catalyst of D (Run No. 4), respectively.

The catalyst bed in Run No. 4 contains an upstream portion containing 5 ml of catalyst D, a following portion containing 5 ml of catalyst C and a most downstream portion containing 5 ml of catalyst B.

In each run, the sulfided single catalysts (Runs Nos. 1 through 3) or combinations of sulfided catalysts (Run No. 4) are charged to a separate reactor and contacted, on a once-through basis, with a feedstock containing iso-octane contaminated with 5000 ppmw sulfur (as thiophene) and 500 ppmw nitrogen (as pyridine). Each run is conducted under the following conditions:

Pressure = 300 p.s.i.g

LHSV = 6/hour

Hydrogen/Hydrocarbon Ratio = 3/1 molar

Temperature = adjusted to give product containing 1-2 ppmw nitrogen

The temperatures required to attain the target nitrogen concentration in the product (equivalent to 99.6-99.8% nitrogen conversion) are summarized in Table III as follows:

TABLE III

| Run No. | Cat. | Temp., °F. |
|---|---|---|
| 1 | B | 540 |
| 2 | C | 550 |
| 3 | D | 575 |
| 4 | D/C/B | 555 |

Such temperatures indicate the D/C/B graded catalyst bed provides a hydrotreating activity better than that of Catalyst B employed alone and nearly as good as that of Catalyst C.

After establishing the above-described conversion temperatures for Run Nos. 1-4, silicon components are added to the feedstock upstream of the reactor in a concentration of 50 ppmw, calculated as Si (as Dow Corning 344 Fluid, which is a polydimethyl cyclosiloxane—a decomposition product of poly dimethyl siloxane antifoam agent used in delayed cokers).

After addition of silicon components to the feedstock, product samples from each of the runs are collected every eight hours and analyzed for nitrogen, sulfur and silicon content. Data are summarized in Tables IV, V and VI. relative to silicon accumulation on the catalyst bed, hydrotreating catalyst stability and hydrotreating catalyst activity compared to silicon accumulation on the catalyst bed, respectively.

TABLE IV

| | | Accumulated Silicon on the Catalyst Bed, wt. % | | | |
|---|---|---|---|---|---|
| Run No. | Cat. | After 50 hrs. | After 75 hrs. | After 100 hrs. | After 125 hrs. |
| 1 | B | 1.4 | 1.65 | 1.7 | 1.75 |
| 2 | C | 1.5 | 2.2 | 2.4 | 2.45 |
| 3 | D | 1.6 | 2.35 | 3.0 | 3.4 |
| 4 | D/C/B | 1.5 | 2.2 | 2.45 | 2.5 |

TABLE V

| | | | Nitrogen (N) and Sulfur (S) Conversion, %, vs. Time, Hours | | | | |
|---|---|---|---|---|---|---|---|
| Run No. | Cat. | Conv. | 25 hrs. | 50 hrs. | 75 hrs. | 100 hrs. | 125 hrs. |
| 1 | B | (N) | 99 | 93.5 | 86.5 | 84 | 82.5 |
| | | (S) | 97.3 | 93.7 | 90.75 | <85 | — |
| 2 | C | (N) | 99 | 96.5 | 90 | 81 | 76 |
| | | (S) | 98.9 | 96.7 | 94 | <85 | — |
| 3 | D | (N) | 99 | 98.2 | 97.5 | 96 | 94 |
| | | (S) | 99.5 | 99.3 | 98.8 | 98.4 | 98 |
| 4 | D/C/B | (N) | 99 | 98 | 96 | 93.5 | 91.5 |
| | | (S) | 98.9 | 98.1 | 97.2 | 96.1 | 95.2 |

TABLE VI

| | | | Nitrogen (N) and Sulfur (S) Conversion, %, vs. Silicon deposition, wt. % | | | | |
|---|---|---|---|---|---|---|---|
| Run No. | Cat. | Conv. | 0.5 | 1.0 | 1.5 | 2.0 | 2.5 |
| 1 | B | (N) | 99 | 97 | 90 | <75 | — |
| | | (S) | 98 | 95.5 | 91.5 | <80 | — |
| 2 | C | (N) | 99 | 98 | 96 | 92.5 | <75 |
| | | (S) | 99.1 | 98 | 96.8 | 95.6 | <80 |
| 3 | D | (N) | 99 | 98.6 | 98.2 | 97.5 | 97 |
| | | (S) | 99.5 | 99.4 | 99.3 | 99.1 | 98.8 |
| 4 | D/C/B | (N) | 99.2 | 99 | 98 | 96.8 | 92 |
| | | (S) | 99.1 | 99 | 98.2 | 97.6 | 95.5 |

Although data in Table IV indicate that the process employing the least active catalyst, Catalyst D alone (the catalyst having the greatest surface area), exhibits the largest silicon accumulation during the course of the run, the data in Table IV indicate the graded catalyst bed (containing equal amounts of Catalyst D, followed by Catalyst C, followed by Catalyst B) exhibits essentially the same or better capacity for silicon accumulation than the capacities of the more active single Catalysts B or C. Surprisingly, as indicated in Table V, both sulfur and nitrogen conversions are maintained at higher levels for longer periods of time (i.e., are more stable) in the process employing the Catalyst D/C/B bed than those processes employing the more active single catalyst beds containing catalysts B or C.

The graded catalyst bed system, having intermediate activity relative to the other single catalyst systems (i.e. better than D, worse than B or C), is more stable than the more active single catalyst systems (B or C), and exhibits better capacity than B or C for silicon accumulation. For instance, the data in Table VI indicate after 2.0 weight percent of silicon has been accumulated on the catalyst beds in Runs 1 through 4 that the conversion of nitrogen and sulfur by the graded D/C/B catalyst bed system of the invention is substantially better than that for the B or C system, i.e. 96.8 nitrogen and 97.6 sulfur vs. less than 75 (nitrogen) and less than 80 (sulfur) for B or 92.5 (nitrogen) and 95.6 (sulfur) for C. Although the system employing the graded bed system of the invention exhibits lower nitrogen and sulfur conversion than the system employing Catalyst D, the graded bed D/C/B system accomplishes the nitrogen and sulfur conversion at much lower temperatures (i.e. 555° F. vs. 575° F.).

In view of the foregoing description of the invention including the examples thereof, it is evident that many alternatives, modifications, and variations can be made by those skilled in the art without departing from the concept of the present invention. Accordingly, it is intended in the invention to embrace all such alternatives, modifications, and variations as may fall within the scope of the appended claims.

We claim:

1. A process for concurrently removing silicon and sulfur or nitrogen from a hydrocarbon-containing feedstock, said process comprising contacting said feedstock serially under hydrotreating conditions, including an elevated temperature above about 450 F. and an elevated pressure above about 50 p.s.i.g., with first an upstream catalyst and then a downstream second catalyst to produce a hydrocarbon-containing product containing a lower concentration of silicon and a lower concentration of sulfur or nitrogen, calculated as the monoatomic elements, than contained in said feedstock, said upstream catalyst having a greater surface area than the surface area of said downstream second catalyst.

2. The process defined in claim 1 wherein said upstream catalyst and said downstream second catalyst each comprise at least one hydrogenation metal component supported on a porous refractory oxide.

3. The process defined in claim 1 wherein, at the same hydrotreating conditions, said downstream second catalyst is more active for sulfur or nitrogen removal from said feedstock than said upstream catalyst when each of said catalysts comprises essentially all of the catalyst utilized in said process.

4. The process defined in claim 1 wherein said downstream second catalyst comprises a greater number of moles of hydrogenation metals, calculated as the free metals, than moles of hydrogenation metals, calculated as the free metals, comprising said upstream catalyst.

5. The process defined in claim 1 further comprising a downstream third catalyst located downstream relative to said downstream second catalyst, said downstream third catalyst having a surface area less than that of said upstream catalyst or said downstream second catalyst.

6. The process defined in claim 5 wherein said downstream third catalyst comprises a greater number of moles of hydrogenation metals, calculated as the free metals, than moles of hydrogenation metals, calculated as the free metals, comprising said downstream second catalyst.

7. The process defined in claim 1 wherein, at the same hydrotreating conditions, said downstream third catalyst is more active than said downstream second catalyst when each of said catalysts comprises essentially all of the catalyst utilized in said process.

8. The process defined in claim 1 wherein said upstream catalyst comprises about 10 to about 90 volume percent of the total catalyst utilized in said process.

9. The process defined in claim 1 wherein said downstream second catalyst comprises about 10 to about 90 volume percent of the total catalyst utilized in said process.

10. The process defined in claim 1 wherein, at the same hydrotreating conditions, said upstream catalyst has a greater capacity for accumulating said silicon than said downstream second catalyst when each of said catalysts comprises essentially all of the catalyst utilized in said process.

11. The process defined in claim 5 wherein, at the same hydrotreating conditions, said downstream second catalyst has a greater capacity for accumulating said silicon than said downstream third catalyst when each of said catalysts comprises essentially all of the catalyst utilized in said process.

12. The process defined in claim 1 wherein said upstream catalyst and said downstream second catalyst comprise at least one Group VIB metal hydrogenation component, at least one Group VIII metal hydrogenation component and at least one phosphorus component on an amorphous, porous refractory oxide support.

13. The process defined in claim 1 wherein said silicon components contained in said feedstock comprise about 0.01 to about 25 ppmw, calculated as Si.

14. The process defined in claim 1 wherein said sulfur components contained in said feedstock comprise at least about 0.02 weight percent, calculated as S.

15. The process defined in claim 1 wherein said nitrogen components contained in said feedstock comprise at least about 2 ppmw, calculated as N.

16. The process defined in claim 1 wherein said feedstock is selected from the group consisting of naphtha, kerosene, diesel fuel, gas oil, turbine fuel and cycle oil.

17. The process defined in claim 1 wherein said nitrogen, sulfur and silicon components in said feedstock comprise organonitrogen, organosulfur and organosilicon compounds, respectively.

18. The process defined in claim 1 wherein said surface area of each of said catalysts is greater than about 100 $m^2/gm$ 19. A hydrotreating process for concurrently removing silicon and sulfur or nitrogen from a hydrocarbon-containing feedstock having at least 90 weight percent of the components boiling at a temperature less than 1,050° F., said process comprising contacting a fixed bed of particulate catalyst with a hydrocarbon-containing feedstock containing (1) silicon and (2) sulfur or nitrogen components under hydrotreating conditions to produce a hydrocarbon-containing product containing a lower concentration of silicon and a lower concentration of sulfur or nitrogen, calculated as the monoatomic elements, than contained in said feedstock, said fixed bed comprising at least two different hydrotreating catalysts each having at least 5 weight percent of at least one hydrogenation metal component, calculated as the metal, on a porous refractory oxide and each having a surface area greater than 100 $m^2$/gram and wherein a first hydrotreating catalyst has a greater capacity for accumulating silicon than the capacity for accumulating silicon of a second hydrotreating catalyst located downstream relative to said first hydrotreating catalyst.

20. The process defined in claim 19 wherein, at the same hydrotreating conditions, said second hydrotreating catalyst is more active for sulfur or nitrogen removal from said feedstock than said first hydrotreating catalyst when each of said hydrotreating catalysts comprises essentially all of said fixed bed.

21. The process defined in claim 19 wherein said first hydrotreating catalyst comprises about 10 to about 90 volume percent of said fixed bed of catalyst.

22. The process defined in claim 19 wherein said first hydrotreating catalyst has a greater surface area than the surface area of said second hydrotreating catalyst.

23. The process defined in claim 19 wherein said sulfur components contained in said feedstock comprise at least about 0.02 to about 4.0 weight percent, calculated as S.

24. The process defined in claim 19 wherein said nitrogen components contained in said feedstock comprise at least about 10 to about 5,000 ppmw, calculated as N.

25. The process defined in claim 19 wherein said feedstock is selected from the group consisting of naphtha, kerosene, diesel fuel, gas oil, turbine fuel and cycle oil.

26. The process defined in claim 19 wherein said nitrogen, sulfur and silicon components in said feedstock comprise organonitrogen, organosulfur and organosilicon compounds, respectively.

27. The process defined in claim 19 wherein said hydrotreating conditions comprise an elevated temperature above about 450° F. and a pressure above about 50 p.s.i.g.

28. A process for concurrently removing silicon and sulfur or nitrogen from a hydrocarbon-containing feedstock, said process comprising contacting a fixed bed of particulate catalyst with a hydrocarbon-containing feedstock comprising a naphtha or diesel fuel and containing sulfur, nitrogen and silicon components under hydrotreating conditions including a temperature in the range from about 500 F to about 800° F. and a pressure from about 100 to about 2,500 p.s.i.g., to produce a hydrocarbon-containing product containing a smaller concentration of (1) said sulfur, (2) said nitrogen and (3) said silicon, calculated as the monoatomic elements, than contained in said feedstock, said fixed bed comprising at least three different hydrotreating catalysts each comprising at least one Group VIB metal hydrogenation component, at least one Group VIII metal hydrogenation component and at least one phosphorus component on an amorphous, porous refractory oxide support containing alumina and each having a surface area greater than about 100 $m^2$/gram and wherein a first hydrotreating catalyst has a greater surface area than the surface area of a second hydrotreating catalyst located downstream relative to said first hydrotreating catalyst and said second hydrotreating catalyst has a greater surface area than the surface area of a third hydrotreating catalyst located downstream relative to said second hydrotreating catalyst.

29. The process defined in claim 28 wherein each of said hydrotreating catalysts comprise at least one nickel or cobalt metal hydrogenation component, at least one molybdenum or tungsten metal hydrogenation component and at least one phosphorus component on said amorphous, porous refractory oxide support comprising gamma alumina.

30. The process defined in claim 28 wherein, at the same hydrotreating conditions, said first hydrotreating catalyst has a greater capacity for accumulating said silicon than said second hydrotreating catalyst when each of said hydrotreating catalysts comprises essentially all of said fixed bed.

31. The process defined in claim 30 wherein, at the same hydrotreating conditions, said second hydrotreating catalyst is more active for sulfur or nitrogen removal from said feedstock than said first hydrotreating catalyst when each of said hydrotreating catalysts comprises essentially all of said fixed bed.

* * * * *

UNITED STATES PATENT AND TRADEMARK OFFICE

CERTIFICATE OF CORRECTION

PATENT NO. : 5,118,406

DATED : June 2, 1992

INVENTOR(S) : Peter Kokayeff, Danford E. Clark, and Howard D. Simpson

It is certified that error appears in the above-identified patent and that said Letters Patent is hereby corrected as shown below:

Claim 4, column 11, line 14, replace "1" with -- 2 --.

Signed and Sealed this

Ninth Day of November, 1993

Bruce Lehman

*Attest:*

BRUCE LEHMAN

*Attesting Officer*

*Commissioner of Patents and Trademarks*